US006062993A

United States Patent [19]

Rodriguez

[11] Patent Number: 6,062,993

[45] Date of Patent: May 16, 2000

[54] DETACHABLE TENNIS VOLLEY PRACTICE DEVICE

[75] Inventor: Carlos H. Rodriguez, Williamsburg, Va.

[73] Assignee: Carlos Rodriguez, Virginia Beach, Va.

[21] Appl. No.: 09/040,381

[22] Filed: Mar. 18, 1998

Related U.S. Application Data

[60] Provisional application No. 60/042,940, Apr. 4, 1997.

[51] Int. Cl.[7] ..... A63B 69/00

[52] U.S. Cl. ..... 473/424; 473/425; 473/459

[58] Field of Search ..... 473/423, 424, 473/425, 426, 427, 428, 429, 430, 431, 432, 459, 473, 474

[56] References Cited

U.S. PATENT DOCUMENTS

| | | | |
|---|---|---|---|
| 1,862,044 | 7/1932 | White . | |
| 2,110,084 | 1/1938 | Heimers . | |
| 2,270,957 | 1/1942 | Mears | 473/424 |
| 3,709,490 | 1/1973 | Pruss . | |
| 4,071,239 | 1/1978 | Ferguson | 473/425 |
| 4,076,239 | 2/1978 | Hall . | |
| 4,836,555 | 6/1989 | Wexler . | |
| 5,083,797 | 1/1992 | Vartija et al. | 473/424 |
| 5,094,462 | 3/1992 | Boyle et al. . | |
| 5,586,760 | 12/1996 | Hauter | 473/424 |
| 5,649,699 | 7/1997 | Todoroff | 473/425 |

FOREIGN PATENT DOCUMENTS 38 21755A1 3/1989 Germany .

OTHER PUBLICATIONS

Soccer Pal Player's Guide, 1994©.

Windball Bungee Bag™ Packaging (date unknown).

*Primary Examiner*—Sam Rimell

[57] ABSTRACT

A tennis teaching aid for use in instructing tennis players in multiple areas of the game, those areas being: (1) teaching a player how to volley(hit balls in the air close to the net) more effectively by limiting reaction time thus forcing a player to use a more efficient stroke, (2) drastically improve eye-hand coordination through the skill required to meet the ball as it returns rapidly to the face of the string bed of the racquet (3) increase all-around skill by increasing the number of repetitions by which a player contacts the ball. The device includes an enclosed net in which a normal tennis ball can be inserted. The net is tethered to the racquet by means of an elastic cord. The connection to the racquet string bed is accomplished by a plurality of separate hooks that are attached to respective elastic chords. These chords are attached to the main elastic chord which leads to the enclosed net which houses the tennis ball.

15 Claims, 2 Drawing Sheets

DETACHABLE TENNIS VOLLEY PRACTICE DEVICE

CROSS REFERENCE TO RELATED APPLICATION

This application claims priority on provisional application Ser. No. 60/042,940 filed on Apr. 4, 1997, the entire contents of which are hereby incorporated by reference.

BACKGROUND OF THE INVENTION

As it is well known to players and teachers of the game of tennis, there are many different strokes that are required to be mastered if a player is to progress in his proficiency in the game. The game can essentially be broken down into three major types of strokes used to impact a tennis ball. The first type of stroke is the forehand and backhand ground-strokes that a player uses while hitting a ball from the baseline of the tennis court. These are essentially long fluid swings of the racquet to send the ball back to the opposing side of the court. Because the tennis player is positioned in the back of the court, he has ample reaction time to produce a long fluid stroke. The second type of stroke is the overhead serve that a player uses to initiate a point. It is also a long fluid stroke that takes place over the shoulder of the player. The reason for the long fluid stroke is that because the player is initiating the point, he has plenty of time to decide when to contact the ball and thus wants to create as much power as possible thus using a longer stroke. The third type of stroke is known as the volley which a tennis player uses when he is near the middle of the full length of the court close to the net. All proficient teachers and players of the game of tennis would describe this as a short more punch-like stroke as a result of the little time afforded to prepare for the ball's arrival as well as the fact that little power is needed to return the ball to the opponents court which is only a few feet away. It is with this particular stroke that this invention is aimed at developing.

Various techniques have been tried over the years to provide players with help in practicing tennis swings though this is the first that is actually specifically focused on developing the volley swing. One type of such device comprises a practice ball, tethered to a support assembly separate from the racket. Examples of such apparatus are shown in U.S. Pat. No. 2,270,957 granted Jan. 27, 1942, to S. W. Mirrs, and U.S. Pat. No. 1,862,044, granted Jun. 7, 1932, to T. M. Flight. While the invention does provide for the imminent return of the ball, it does create a low return trajectory that a player must stoop to intercept, which is quite unlike the volley position in which a ball is struck usually from waist to shoulder height. Also, the long amount of time required for the ball to return as a result of the long elastic tether does not create an environment is which the tennis player is forced to use a short punching swing necessary to effect a correct volley stroke.

Also of interest is the type of tennis practice device which has a tethered ball attached to a the handle portion of the tennis racquet such as that shown in U.S. Pat. No. 3,709,490, granted Jan. 9, 1973, to Gunther Pruss. The disadvantage of attaching the tether to the handle portion of the tennis racquet is that the ball may tend to return toward the handle portion of the racquet. The swivel bearing clip connecting the tether to the racquet also affects the weight of the racket and with today's more modern open throated racquets is no longer an applicable connection device.

A similar invention is the tennis device depicted in U.S. Pat. No. 2,110,084 granted Mar. 1, 1938, to R. Heimers. This system has an elastic tether which is wrapped around an upper and lower roller assembly and has a projectable ball attached at it's outward end. This device is bulky and weighty and significantly changes the balance of the tennis racket. Like the above practice device, there will be a tendency for the ball to return to the outward end of the racket rather than the center of the string bed.

Of particular interest is the type of tennis device shown in U.S. Pat. No. 4,071,239, granted Jan. 31, 1978, to T. Ferguson. This system has an elastic tether which connects a flexural arcuate anchor attached to the string bed to a cross member which secures a conventional ball to the tether. The anchor is somewhat bulky and alters the rebound energies of the string bed when struck by the ball because of its position flush to the strings. This disables the tennis player from the ability to get a correct 'feel' when striking the ball in the center of the racquet. In addition, it is time consuming to thread the elastic tether through a rectangular opening in the string bed, attach it to the flexural anchor, attach the anchor to the string bed, and then to attach the elastic cross fastener at the end of the elastic tether to the ball.

It will be appreciated from the foregoing that there is still a definite need to provide a simple and inexpensive teaching tool that is simple, inexpensive, unobtrusive, light in weight, and easily attachable to the racquet, to create a conducive environment is which a volley stroke can be practiced in conditions similar to that experienced in a conventional game.

SUMMARY OF THE INVENTION

The present invention relates to a device for practicing tennis volleys, and, more particularly, to a rapidly detachable string mounted device (by means of one or several anchor loops or hooks) that connects to an elastic tether connected to a small enclosed net by which a player can insert a tennis ball. The player can then impact the ball with the racquet sending the ball in an appropriate trajectory and ensure its return in an exactly opposite trajectory by means of the elastic tether and enclosed net which contains the ball that was struck while housed in the net.

The present invention is particularly useful for practicing tennis strokes, specifically the particular stroke in tennis known as the volley. More specifically, the device is a disconnectable system for a conventional tennis racket which incluces a tethered ball projectile by use of an elastic tether and an enclosed net. Briefly and in general terms, the device is anchored to the string bed by use of a plurality of, preferably 2 to 5, most preferably 3 demountable hooks, which quickly connect to the string bed at three separate locations resembling the corners of a triangle. These three hook anchors are connected to a central elastic chord by means of three elastic chords. The elastic chord has a gauge anywhere from a diameter of $1/32^{nd}$ of an inch to $1/6^{th"}$ of an inch preferably $3/32^{nd}$ of an inch. The elastic chord can be manufactured out of any elastic material such as rubber. The elastic material may or may not be sheathed in a protective coating such as nylon, cotton, or polypropylene. The elastic properties of the material used dictate a stretch of 75% to 250% of original length, preferably 100%. All chord used in this device have these properties. Of those three chords, one chord is simply an extension of the main elastic chord which is connected to the net housing. The other two elastic chords are actually one chord which is tied to the main elastic chord two create two equally long pieces of chord which leads to the other two hooks. The net effect is three distinct chord pieces of equal length extending from a central knot which connects to the main shaft of the elastic tether chord which connects to the net housing in which resides the tennis ball. The main shaft of the elastic chord which extends from the unifying knot will usually be a length of 3 to 5 feet preferably 4 feet in it's relaxed state depending on the type of elastic tether used. The three distinct equal length chord sections extending from the unifying knot and connecting to the racket string bed viai the plurality of demountable hooks should be 1 to 5 inches in length, preferably 2 inches in their respective relaxed state. The hook anchors are placed in three separate sections of the string bed, elongated far enough from each other that they create offsetting tensions which hold the hooks in place. This secures the device to the racket. When placed in appropriate positions, the end result is that the end of the main elastic chord that the three anchors are attached to is positioned in the center of the racket and held fast in that position by the three anchors. The main elastic chord extends out from the racket where at the end of it is attached a small net only slightly larger than the size of a tennis ball. The net is a flexible enclosure made of materials such as cotton, nylon, or polypropylene. The net is Large enough to accommodate a conventional size tennis ball having a diameter of about 2¾ inches and can be up to 50% larger than a tennis ball but is preferably only slightly larger, 10%–30% than a conventional tennis ball. The elastic tether is intertwined with the net and then connected back to itself in such a way as it can be used like a drawstring to open the net just barely enough to provide entry for a conventional tennis ball, and also closed.

An alternative method for mounting the device to the racket is by means of a loop rather than a plurality of hooks. What is meant is that the main elastic tether, which is connected to the net, has a loop at the opposite end of the chord which is created by tying the chord to itself, thus creating an opening. Since the chord is elastic, the device can be mounted by passing the loop around an individual racket string on the string bed (preferably in the center of the string bed), and then passing the collapsed net, without tennis ball inserted, as well as the rest of the main elastic chord through the opening created by the loop. Upon placing a ball in the net and commencing to hit the ball, the tension created by the expanding elastic chord produced by the racket contacting the ball in the net housing, causes the loop to tighten around the main part of the elastic chord, thus fastening it securely to the string bed of the racket.

In view of the foregoing, it is a purpose of this invention to provide a detachable tennis device that will accurately simulate a ball approaching at rapid velocity through means of an elastic tether positioned at the center of the racket string bed. It is another purpose of this device in that the user, in light of the repeatedly approaching ball enclosed in the net, will have to react accordingly using short punch-like motions rather than long fluid swings, thus learning the correct way to volley a tennis ball. It is yet another purpose that this invention be easily attachable and demountable with the ability to be connected and disconnected within seconds. It is yet another purpose that this device being easily transportable with the ability to be carried around in a racket cover for usage at any preferred moment. It is yet another purpose of this device that it be extremely light and not alter the current weighting of the racket. It is yet another purpose of this device that it not alter the string bed significantly enough to create unrealistic hitting conditions. It is yet another purpose of this device that it can be used with conventional equipment and can be demounted so that the equipment can be also used in conventional play. It is yet another purpose of this device that it be simple to attach and understand and durable in use. Other aspects and advantages of the present invention will become apparent from the following and more detailed description taken in conjunction with the accompanying drawings.

DETAILED DESCRIPTION OF THE DRAWINGS

Figure 1:
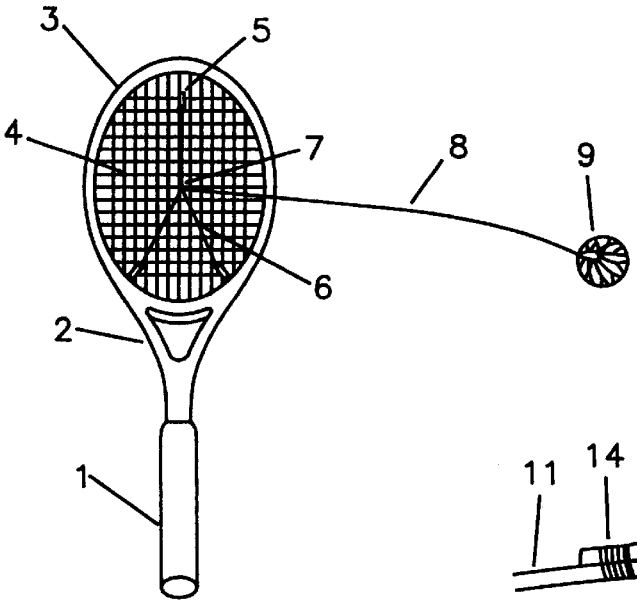
FIG. 1 is a pictorial view showing the aforesaid mentioned tennis device attached by it's detachable hooks to a conventional tennis racket.

In FIG. 1, a conventional tennis racket is shown having the detachable tennis practice device attached. A conventional tennis racket essentially consists of a handle 1, a throat 2, and a head 3. The racket head has a plurality of openings in its frame which allow for strings to be received through the openings and interwoven forming a racket face comprised of strings along mutually perpendicular axes 4. The perpendicular crossings of the strings create a plurality of square openings along the racket face. As seen in the figure, the detachable tennis device is attached to the racket by means of three hooks located at three different sectors of the string bed 5. Three distinct elastic chords 6 lead from their respective hooks to a central knot 7, which leads to a long elastic tether 8. At the end of the tether is a net housing 9 which contains an insertable conventional tennis ball.

Figure 2:
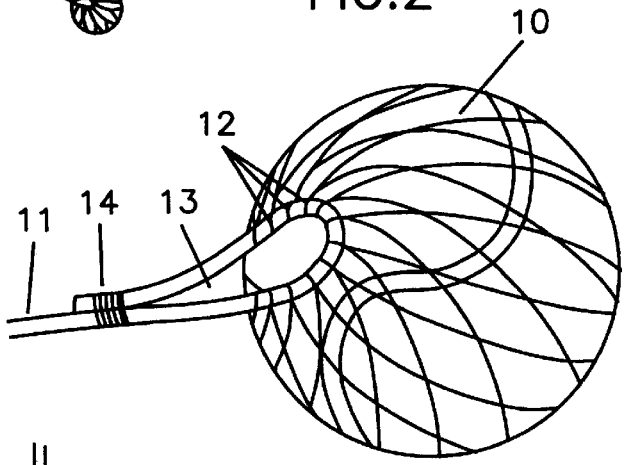
FIG. 2 is a side elevational view of the net assembly which holds a conventional tennis ball and is attached to an elastic tether leading to a tennis racket.

FIG. 2 provides a detail drawing of the net housing containing it's ball and it's connection to the long elastic tether. The net 10 is made of common ordinary materials such as nylon or polyester, and is slightly larger than a tennis ball. The net is connected to the elastic chord 11 by means of running the chord through a plurality of openings in the net 12 and then fashioning a loop 13 by sealing the chord to itself whether through sewing or binding 14.

Figure 3:
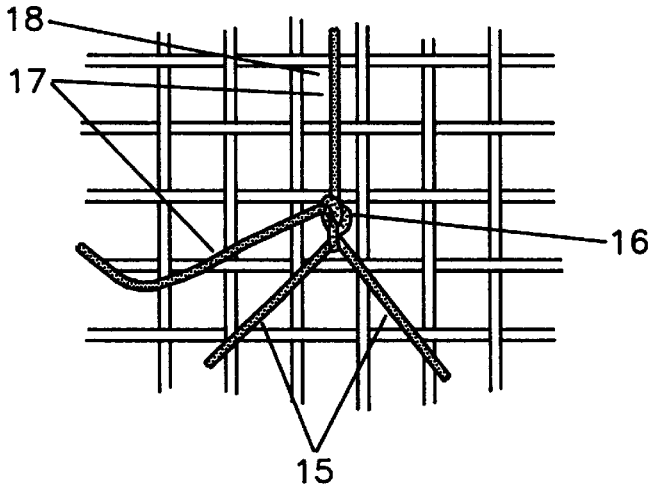
FIG. 3 is a front elevational view of the connection between the main elastic tether and a second elastic chord. The connection accomplished by means of a knot creating three distinct chords of equal length which lead to three separate hooks.

FIG. 3 provides a detail drawing of the connection of the main elastic tether 8 as seen in FIG. 1, to a second elastic chord. The Second chord 15 is attached by means of conventional knot, or binding, or sewing 16, to the main elastic tether 17 in the correct position so that the chord produces two equidistant lengths of chord 15 along with a third equidistant piece 18 of chord which is simply an extension of the main elastic tether 17.

Figure 4:
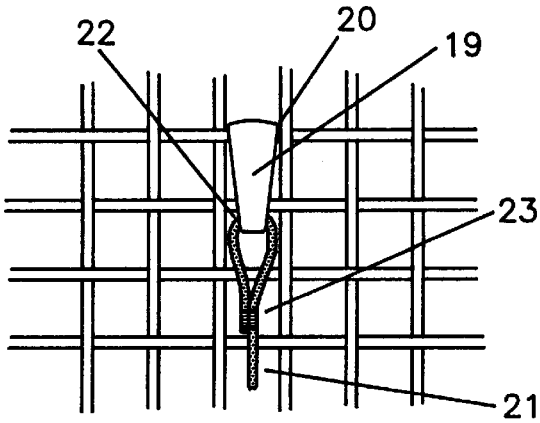
FIG. 4 is a front elevational view of a hook illustrating it's attachment to an elastic chord as well as to an individual string on the string bed of the tennis racket.

FIG. 4 is a detailed front elevational view of a detachable hook 19 connected to an elastic chord by means of it's angular claw 20. The elastic chord 21 is connected to the detachable hook 19 by encircling the enclosed receiver 22 on the rear of the detachable hook and then attaching to itself 23 by means of a conventional knot, sewing, or binding. The hook is held in place by means of the offsetting tensions of the other two hooks located in different sectors of the string bed serving to form a triangular type appearance.

Figure 5:
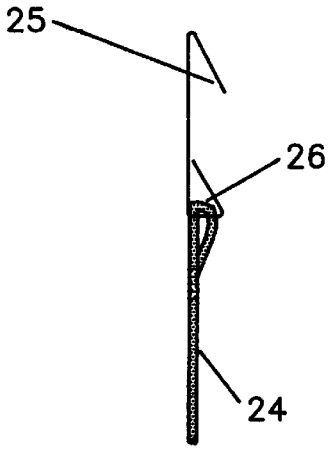
FIG. 5 is a side elevational view of the hook seen in FIG. 4.

FIG. 5 is a detailed side elevational view of the hook assembly and it's connection to the elastic chord 24. This view provides a better view of the angular claw 25 which attaches to an individual string on the string bed, as well as the enclosed receiver 26 located on the rear of the detachable hook through which the elastic chord 24 encircles to secure itself to the hook.

Figure 6:
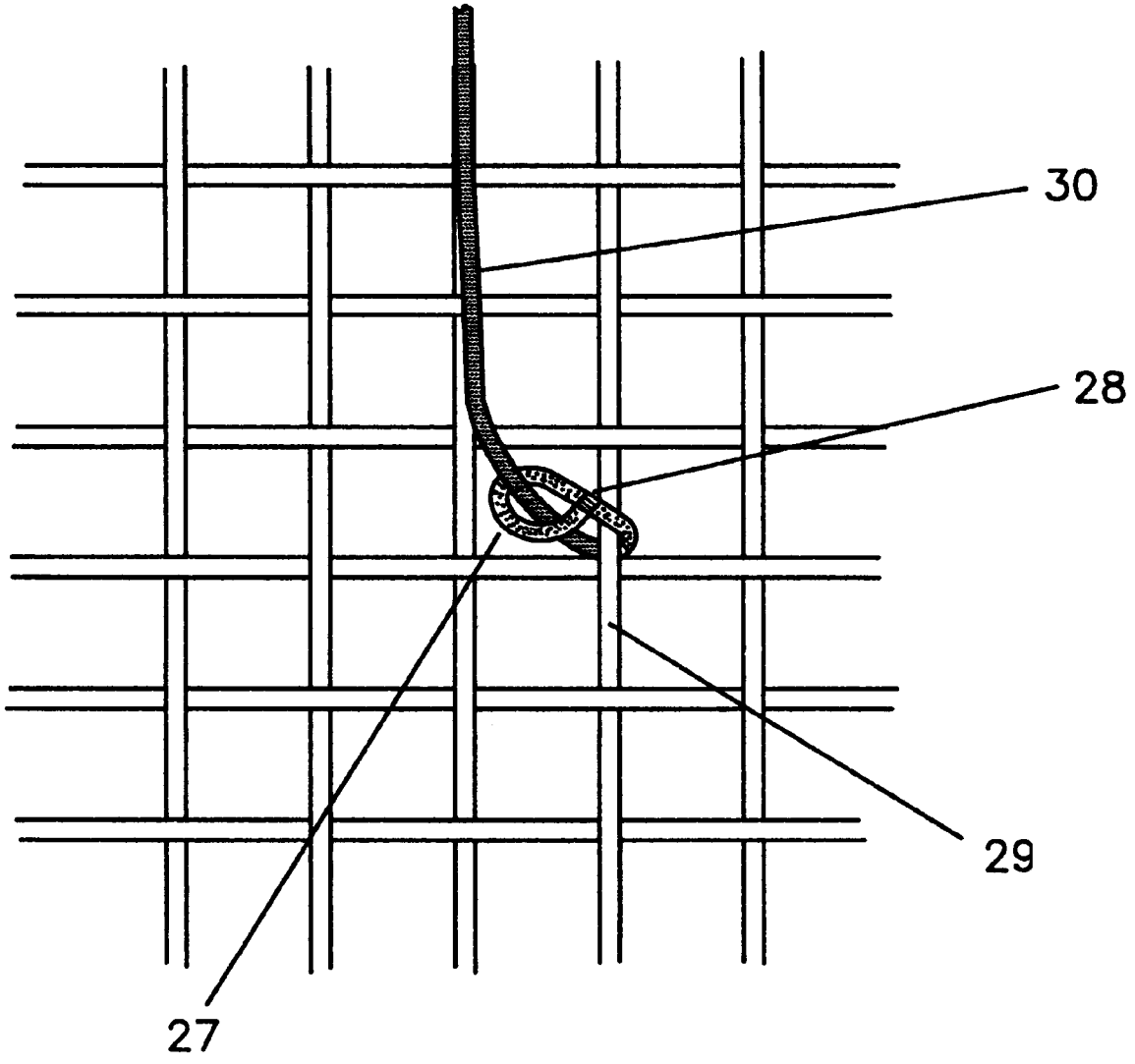
FIG. 6 is a front elevational view of the second embodiment of the invention.

FIG. 6 provides a detailed front elevational view of a second attachment method for connecting the device to the string bed. A loop 27 is created by fastening the main elastic chord to itself 28 and then running the chord around an individual racket string to hold it in place 29 at or near the center of the string bed. The main shaft of the elastic tether 30 proceeds from the chords connection with the racket face to the flexible enclosure net which houses the ball.

USE OF INVENTION

The device is relatively simple to use. Preparation for use of the device entails; connecting the three detachable hooks 5 to the string bed in a shape representing the corrers of a triangle. The connection of the hooks must be made so that offsetting tension is created by the opposing hooks. The hooks should be placed in such a way that the unifying knot 16 is located near an imaginary line which extends perpendicular from the center of the string bed. Alternatively, a device as described in FIG. 6 is secured to the string bed by a single connection at or near the center of the string bed. A conventional tennis ball is then placed in the net housing 9. The user then holds the racket with the string bed 4 parallel to the floor. The ball and elastic tether extend from the string bed towards the floor and are perpendicular to the floor. The user initiates use of the device by turning the racket handle 1 and swinging the ball outward in a pendulum type motion. When the ball and elastic tether lies parallel to the floor and the string bed lies perpendicular to the floor, the user pulls the racket away from the ball thus causing the ball to accelerate toward the racket because of the elastic properties of the tether. As the ball approaches the racket, the user reverses the retreating action of the racket and accelerates the racket towards the ball. The ball impacts the racket in the center of the string bed causing it to accelerate in the direction it was hit by the racket. As the tether lengthens to it's full extension, the user keeps his/her wrist in a firm position causing the racket to remain immobile from the point it struck the ball. The result is that the ball only goes a certain distance before the elastic properties of the tether recall the ball and it accelerates toward the racket again. Because the acceleration/deceleration of the ball is so rapid, and it's return follows quickly thereafter, the user has no time to pull his/her racket in any direction without failing to meet the ball squarely on the next hit. The result is a learning process that the user undergoes. The user learns that the key to sustaining a "rally" of consecutive solid hits is to keep the racket very still and use a blocking motion, rather than a swinging motion. This teaches a user to volley correctly in a real life situation. The result of a user who has mastered the device is the ability to hit the ball a number of times consecutively with the ball accelerating away from the racket, being pulled back by the elastic tether, and repeating the motion again and again and again.

What is claimed is:

1. A packaged combination of a tennis training device and instructions, comprising:

a package containing a training device comprising a flexible enclosure adapted to receive a tennis ball, an elastic tether having two ends, one end of said elastic tether being attached to said flexible enclosure, and means for attaching the other end of said elastic tether to the strings of a tennis racket, said means for attaching being located at the other end of said elastic tether, wherein said means for attaching does not substantially affect the normal impact of a tennis ball at the center of the string bed of a tennis racket, said means for attaching comprising a plurality of elongated flexible elastic members attached to said other end of said elastic tether and a plurality of fasteners connected to respective different of said elongated flexible elastic members for connection with strings on a tennis racket at a plurality of distinct points spaced from said center of said string bed, wherein said plurality of fasteners are spaced far enough from each other that they create offsetting tensions which hold the fasteners in place; and instructions associated with said packaged combination which explain how to releasably secure the training device to a tennis racket, said instructions including the steps of placing a tennis ball in said flexible enclosure and connecting said plurality of fasteners to said string bed of said tennis racket at said distinct points spaced from the center of the are a defined by said string bed.

2. The packaged combination of claim 1, wherein said instructions also explain how to use said training device to practice tennis.

3. A tennis racket having a training device secured to a string bed thereof, comprising:

a flexible enclosure adapted having a tennis ball inside of said flexible enclosure;

an elastic tether having two ends, one end of said elastic tether being attached to said flexible enclosure; and a plurality of elongated flexible elastic members attached to said other end of said elastic tether and a plurality of fasteners connected to respective different of said elongated flexible elastic members connected with said string bect on said tennis racket at a plurality of distinct points spaced from the center area defined by said string bed, wherein said plurality of fasteners are spaced far enough from each other that they create offsetting tensions which hold the fasteners in place.

4. A tennis racket having the training device of claim 2 secured to the strings thereof and having a tennis ball inside of said flexible enclosure.

5. The tennis racquet of claim 4, wherein said flexible members are attached to said strings at three or more points spaced from each other and near the frame of said racket.

6. A packaged combination of a tennis training device and instructions, comprising:

a training device comprising a flexible enclosure adapted to receive a tennis ball, an elastic tether attached at one end to said flexible enclosure, a plurality of elongated flexible elastic members at the other end of said elastic tether and a plurality of fasteners connected to respective different of said elongated flexible elastic members for connection with a string bed of a tennis racket at a plurality of distinct points not in the center area defined by said string bed;

a package containing said training device; and instructions associated with said training device which explain how to releasably secure the training device to a tennis racket, said instructions including the steps of placing a tennis ball in said flexible enclosure and connecting said plurality of fasteners to said string bed of said tennis racket at points remote from the center of the area defined by said string bed, wherein said plurality of fasteners are spaced far enough from each other that they create offsetting tensions which hold the fasteners in place.

7. The packaged combination of claim 6, which comprises at least three of said fasteners.

8. The packaged combination of claim 6, wherein said instructions instruct the user to connect said fasteners to said strings on the same side of said strings as said at least two flexible members.

9. The packaged combination of claim 7, wherein at least one of said elongated flexible members is an extension of said elastic tether.

10. The packaged combination of claim 6, wherein said tether and said plurality of elongated flexible members are made from the same type of elongated flexible elastic material and said flexible members are directly connected with said elastic tether.

11. The packaged combination of claim 1, which comprises at least three of said fasteners.

12. The packaged combination of claim 1, wherein said instructions instruct the user to connect said fasteners to said string bed on the same side of said string bed as said at least two flexible elastic members.

13. The packaged combination of claim 1, wherein at least one of said elongated flexible elastic members is an extension of said elastic tether.

14. The packaged combination of claim 1, wherein said tether and said plurality of elongated flexible elastic members are made from the same type of elongated flexible elastic material and said flexible elastic members are directly connected with said elastic tether.

15. The packaged combination of claim 1, wherein said fasteners are hooks.

* * * * *